United States Patent [19]

Harris

[11] Patent Number: 5,063,485

[45] Date of Patent: Nov. 5, 1991

[54] ILLUMINATED ARTIFICIAL FLOWERS

[76] Inventor: Edward H. Harris, 216 Hillcrest, Henderson, Nev. 89015

[21] Appl. No.: 451,980

[22] Filed: Dec. 18, 1989

[51] Int. Cl.[5] ..... F21V 33/00

[52] U.S. Cl. ..... 362/122; 362/806

[58] Field of Search ..... 362/122, 123, 226, 800, 362/806

[56] References Cited

U.S. PATENT DOCUMENTS

| | | | |
|---|---|---|---|
| 1,440,589 | 1/1923 | Flender . | |
| 1,938,736 | 12/1933 | Berman | 362/122 |
| 2,277,611 | 3/1942 | Schaaf | 240/10 |
| 2,416,802 | 3/1947 | Roung | 362/123 |
| 2,485,460 | 10/1949 | Rocco | 362/123 |
| 2,760,052 | 8/1956 | Owen | 362/123 |
| 3,146,955 | 9/1964 | Sabuco | 240/6.4 |
| 4,171,754 | 10/1979 | Rosado | 362/122 |
| 4,399,493 | 8/1983 | Kurita et al. | 362/122 |

*Primary Examiner*—Ira S. Lazarus
*Assistant Examiner*—Richard R. Cole
*Attorney, Agent, or Firm*—John E. Benoit

[57] ABSTRACT

An illuminated artificial floral arrangement is provided which includes a container and a stem support member within the container with an electrical terminal block being mounted on the stem support. At least one artificial flower having a stem extending into the support member extends above the container and includes at least one low voltage lamp mounted within the center of the flower. Electrical leads are wound about the stem and connect the low voltage lamp to the terminal block. A low voltage transformer is provided externally of the container and electrical leads connect the terminal block to the transformer, with the transformer having means for connection to a standard electrical outlet.

1 Claim, 2 Drawing Sheets

ILLUMINATED ARTIFICIAL FLOWERS

The present invention relates to the illumination of artificial flowers and more particularly to the illumination of delicate artificial flowers such as silk flowers with low voltage light bulbs.

Illumination of flowers and artificial flowers has been proposed and some systems are available on the market today. To the knowledge of the inventor, however, the available illuminated artificial flowers are limited in the type of flower which may be utilized, as well as the actual floral arrangement and type of container or vase used to hold the arrangement or flower. For instance, the flower to be illuminated is usually built around the light bulb with a distinctive style of flower and vase being used, with the result that only one style is offered. Thus, instead of having a delicate silk flower, which is close to nature in appearance, the result is quite obviously an artificial flower which is often unacceptable or unattractive. Because of the manufacture and use of the type of light bulbs available, it is simply not practicable, and sometimes not possible, to use modern delicate silk flowers which are available today.

The present invention provides a system for illumination of artificial floral arrangements or flowers and/or foliage by the placement of low voltage lamps within the floral arrangements, either in the flowers or foliage. More specifically, an individual low voltage lamp is normally placed in the receptacle of the flower at the base of the petals. On artificial arrangements which utilize buds or foliage, the low voltage lamp can be placed in such an area as to highlight or accent the buds or foliage.

With the present invention, a floral arrangement may be made using delicate silk flowers with the lights then being attached to the arrangement. The advantages of this arrangement over a pre-made illuminated floral arrangement is obvious.

Accordingly, it is an object of the present invention to provide illuminated floral arrangements using delicate silk flowers and low voltage lamps.

A further object of the invention is to provide an illuminated artificial floral arrangement in which similar styles of flowers or completely different styles can be grouped together to form such a floral arrangement.

A still further objection of the invention is to provide a holder in which the flowers can easily be inserted and bulbs can be removed and repaired or replaced.

These and other objects of the invention will become apparent from the following description, taken together with the drawings.

SUMMARY OF THE INVENTION

The invention provides an illuminated artificial floral arrangement which includes a container and a stem support member within the container with an electrical terminal block being mounted on the stem support. At least one artificial flower having a stem extending into the support member extends above the container and includes at least one low voltage lamp mounted within the center of the flower. Electrical leads are wound about the stem and connect the low voltage lamp to the terminal block. A low voltage transformer is provided externally of the container and electrical leads connect the terminal block to the transformer, with the transformer having means for connection to a standard electrical outlet.

DETAILED DESCRIPTION OF THE PREFERRED EMBODIMENTS

Figures 1, 2:
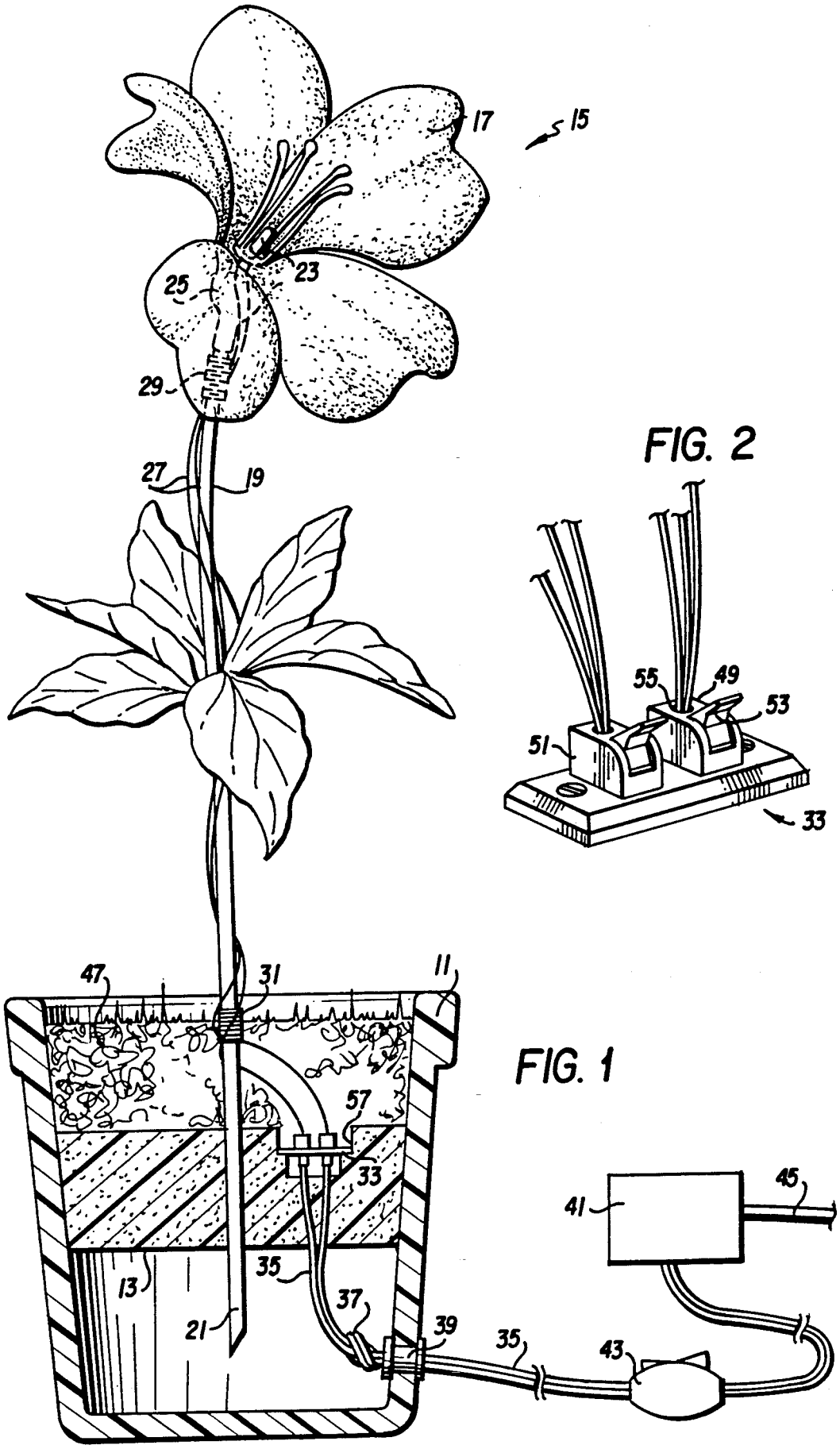
FIG. 1 is a partial sectional side elevational view showing a flower, container, and electrical connections used in the present invention.
FIG. 2 is a perspective view of a terminal block which may be used with the present invention.

Referring to FIG. 1, there is shown container 11 such as a flower pot having mounted therein platform 13 of a penetratable material such as Styrofoam. Artificial flower 15, such as one made of silk, includes petals 17 and stem 19. Stem 19 terminates at its distal end in a pointed tip which may be passed into the Styrofoam platform 13 so that the flower is held in place.

Low voltage lamp 23 is placed in the center portion 25 of flower 15. Insulated magnet wire 27 extends from low voltage lamp 23 and is wrapped around stem 19 and led into container 11. The wires may be secured to the stem at the upper and lower ends by means of floral tape 29 and 31.

The terminal ends of wires 27 are secured within terminal block 33. Leads 35, such as 18-gauge zip wire, extend from terminal block 33 outwardly of container 11. Leads 35 preferably use a strain-relief element 37 inside the container prior to the grommet 39 which holds the wires in place relative to container 11. Switch 43 connects leads 35 to low voltage transformer 41. Low voltage transformer 41 has leads 45 which are connected to a standard 110-volt outlet (not shown). In order to complete the assembly, there is provided an insulated cover 47, similar to Spanish Moss.

FIG. 2 is a perspective illustration of one type of terminal block 33 which may be used. As shown, this terminal block has a positive terminal 49 and a negative terminal 51 mounted thereon. These are of the well known type snap terminals wherein the appropriate wires from the flowers or foliage are inserted into cavity 55 and levers 53 are pressed downwardly so as to cause contact of the wires within the terminals. Leads 35 are soldered to the other side of terminal block 33 so as to complete the connections. As can be seen, terminal block 33 is mounted within recess 57 in platform 13.

Figure 3:
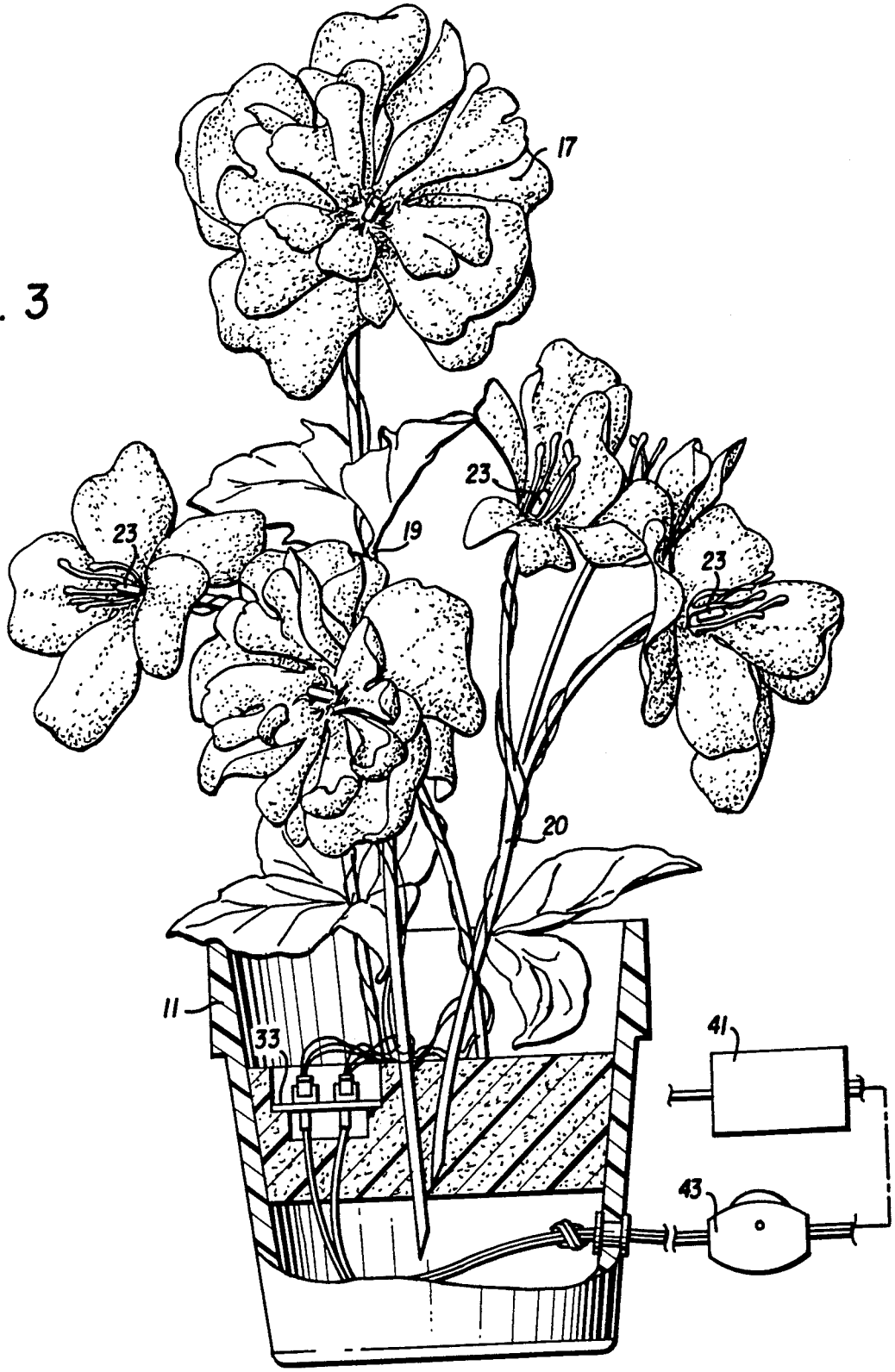
FIG. 3 is a partial sectional view of an illuminated artificial silk floral arrangement embodying the present invention.

Referring to FIG. 3, there is illustrated an arrangement which may be made with a plurality of flowers 17 and a plurality of low voltage bulbs 23 arranged within the flowers. As indicated, bulbs 23 may also be located within the foliage and may be arranged in any style desired. Each flower has its own stem and wire. In FIG. 3, a second stem 20 is illustrated. Obviously, the principle of the invention can be used in making floral sprays as well as all types of arrangements wherein the lamps are placed within the silk flowers and the flowers are arranged in the holder in the desired aesthetic arrangement. Subsequently, all magnet wire leads from individual flowers are then passed to the terminal block and the arrangement is complete and ready for use.

It is to be understood that the invention is not limited solely to artificial flowers, but can also be used in conjunction with artificial foliage such as trees, moss, ferns, etc. Additionally, natural items which are utilized in producing a floral arrangement may also be used.

Preferably, the magnet wire used would normally be of a green color so as to be as unobtrusive as possible.

The above description and drawings are illustrative, only, since modifications could be made without departing from the invention, the scope of which is to be limited only by the following claims.

I claim:

1. An illuminated artificial floral arrangement comprising a hollow container;

a platform of penetrable material secured within said container between the top and bottom thereof;

an electrical terminal block mounted within said platform and accessible from the upper side thereof;

a plurality of artificial flowers having petals and a stem, each of said stems having a pointed tip so that they can be selectively removably inserted through said platform whereby said flowers are supported by said platform;

a plurality of low voltage lamps secured within said artificial flowers;

electrical leads wound about said stems and interconnecting said low voltage lamps to said electrical terminal block;

a low voltage transformer;

electrical leads connected to and extending from said terminal block through said container and connected to said low-voltage transformer;

means for connecting said low voltage transformer to a standard electrical outlet; and insulated decorative cover material extending above said platform and said terminal block for concealing the platform and block.

* * * * *